US008023865B2

(12) United States Patent
Ito et al.

(10) Patent No.: US 8,023,865 B2
(45) Date of Patent: Sep. 20, 2011

(54) DEVELOPING APPARATUS AND IMAGE FORMING APPARATUS

(75) Inventors: Katsuyuki Ito, Tokyo (JP); Akihiro Yamamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1122 days.

(21) Appl. No.: 11/753,596

(22) Filed: May 25, 2007

(65) Prior Publication Data

US 2007/0274744 A1 Nov. 29, 2007

(30) Foreign Application Priority Data

May 29, 2006 (JP) ..... 2006-148403

(51) Int. Cl.
*G03G 15/08* (2006.01)

(52) U.S. Cl. ..... 399/265

(58) Field of Classification Search ..... 399/265, 399/281

See application file for complete search history.

(56) References Cited

FOREIGN PATENT DOCUMENTS

| | | | | |
|---|---|---|---|---|
| JP | 61292180 | A | * | 12/1986 |
| JP | 62-095558 | A | | 5/1987 |
| JP | 7-46246 | B2 | | 5/1995 |
| JP | 08292631 | A | | 11/1996 |
| JP | 2003043818 | A | | 2/2003 |
| JP | 2003131490 | A | * | 5/2003 |
| JP | 2006106223 | A | | 4/2006 |

* cited by examiner

*Primary Examiner* — David Gray
*Assistant Examiner* — Erika J Villaluna
(74) *Attorney, Agent, or Firm* — Panitch Schwarze Belisario & Nadel LLP

(57) ABSTRACT

A developing apparatus includes a developing roller, a first shaft, a second shaft, a belt, and a power supply. The developing roller is in contact with an image forming body. The first shaft is driven in rotation by an external drive source. The belt is entrained about the first and second shafts, and is partially at first and second portions in a wrapping contact with the developing roller. The power supply applies voltages to the first and second shafts such that a voltage drop appears in the belt in a direction of travel of the belt. The power supply applies a voltage to the developing roller such that a first electric field is developed across the developing roller and the first portion, and such that a second electric field in the opposite direction to the first electric field is developed across the developing roller and the second portion.

24 Claims, 3 Drawing Sheets

DEVELOPING APPARATUS AND IMAGE FORMING APPARATUS

BACKGROUND OF THE INVENTION

1. Field of the Invention

The present invention relates to a developing apparatus and an image forming apparatus that incorporates the developing apparatus.

2. Description of the Related Art

Among conventional image forming apparatuses based on electrophotography are printers, copying machines, facsimile machines, and other multi function apparatuses. A printer performs electrophotographic processes including charging exposing, developing, transferring, cleaning and neutralizing. Through these processes, a toner image is formed on a photoconductive drum, and is transferred onto a medium such as paper. Subsequently, the toner image is fixed into a permanent image.

An electrophotographic printer incorporates a developing unit that usually uses one-component toner. A toner supplying roller formed of sponge supplies the toner to a developing roller, which in turn supplies the toner to the photoconductive drum to develop an electrostatic latent image with the toner into a toner image.

During developing process, only the toner on the developer roller that is brought into contact with the electrostatic latent image is transferred to the photoconductive drum to develop the electrostatic latent image, and the rest remains on the photoconductive drum. This may leave a reversal image of the electrostatic latent image on the developing roller.

SUMMARY OF THE INVENTION

An object of the invention is to solve drawbacks of conventional image forming apparatuses.

Another object of the invention is to provide a developing apparatus that prevents a reversal image of the electrostatic latent image from being left in the layer of toner on a developing roller, and an image forming apparatuses that incorporates such a developing apparatus.

A developing apparatus includes a developer bearing body that supplies developer to an image bearing body. The developing apparatus includes a developer supplying belt and a voltage supply. The developer supplying belt supplies developer to the developer bearing body. The voltage supply causes a first voltage to be developed on a first point on the developer supplying belt and that causes a second voltage to be developed on a second point on the developer supplying belt. The developer supplying belt is in contact with or in proximity to the developer bearing body.

The developing apparatus further includes a drive shaft and a driven shaft. The drive shaft is driven in rotation by an external drive source. The drive shaft causes the developer supplying belt to run. The driven shaft is rotated by the developer supplying belt when the developer supplying belt runs. The power supply applies voltages to the drive shaft and driven shaft to produce the first voltage and the second voltage, the voltage applied to the drive shaft being different from the voltage applied to the driven shaft.

The first voltage creates an electric field through which the developer is supplied from the developer supplying belt to the developer bearing body. The second voltage creates an electric field by which the developer is recovered from the developer bearing body to the developer supplying belt.

A developing apparatus includes a developer bearing body that supplies developer to an image forming body. The apparatus includes a drive shaft, a driven shaft, a developer supplying belt, an urging member, and a voltage supply.

The drive shaft is driven in rotation by an external drive source. The developer supplying belt is entrained about the drive shaft and the driven shaft, the developer supplying belt supplying developer to the developer bearing body. The urging member maintains the developer supplying belt in tension. The voltage supply develops a potential difference across the drive shaft and the driven shaft.

The developer supplying belt is in an abutting relation with the developer bearing body.

The voltage supply creates the first voltage at a first point at which the developer supplying belt contacts the developer bearing body and the second voltage at a second point at which the developer supplying belt contacts the developer bearing body.

The first voltage develops a first electric field across the developer supplying belt and the developer bearing body, the developer being supplied from the developer supplying belt to the developer bearing body through the first electric field. The second voltage develops a second electric field across the developer supplying belt and the developer bearing body, the developer being recovered from the developer bearing body to the developer supplying belt through the second electric field.

The developer supplying belt is formed of a semi-conductive material having a volume resistivity in the range of $10^6$ to $10^8$ Ωcm.

The developing apparatus further includes a rotating body that rotates in contact with the developer supplying belt.

The developing apparatus further includes a rotating body that rotates in contact with the developer supplying belt.

An image forming apparatus incorporates the aforementioned developing apparatus.

A developing apparatus includes a developer bearing body, a first shaft, a second shaft, a developer supplying belt, and a power supply. The developer bearing body is in contact with an image forming body. The first shaft is driven in rotation by an external drive source. The developer supplying belt is entrained about the first shaft and second shaft, the developer supplying belt being partially in a wrapping contact with the developer bearing body. The power supply applies voltages to the first shaft and the second shaft such that a voltage drop appears in the developer supplying belt in a direction of travel of the developer supplying belt. The power supply applies a voltage to the developer bearing body such that a first electric field having a first direction is developed across the developer bearing body and a first portion of the developer supplying belt in contact with the developer bearing body, and such that a second electric field having a second direction opposite to the first direction is developed across the developer bearing body and a second portion of the developer supplying belt in contact with the developer bearing body.

The first electric field allows the developer to be supplied from the developer supplying belt to the developer bearing body.

The second electric field allows the developer to be recovered from the developer bearing body to the developer supplying belt.

The developing apparatus further includes an urging member that urges the developer supplying belt to maintain the developer supplying belt in tension.

The developer supplying belt is formed of a semi-conductive material having a volume resistivity in the range of $10^6$ to $10^8$ Ωcm.

The developing apparatus further includes a rotating body that rotates in contact with the developer supplying belt at a portion after the developer has been recovered from the developer bearing body to the developer supplying belt.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The invention will be described in detail with reference to the accompanying drawings. The image apparatus according to the invention will be described with respect to a printer.

First Embodiment

Figure 1A:
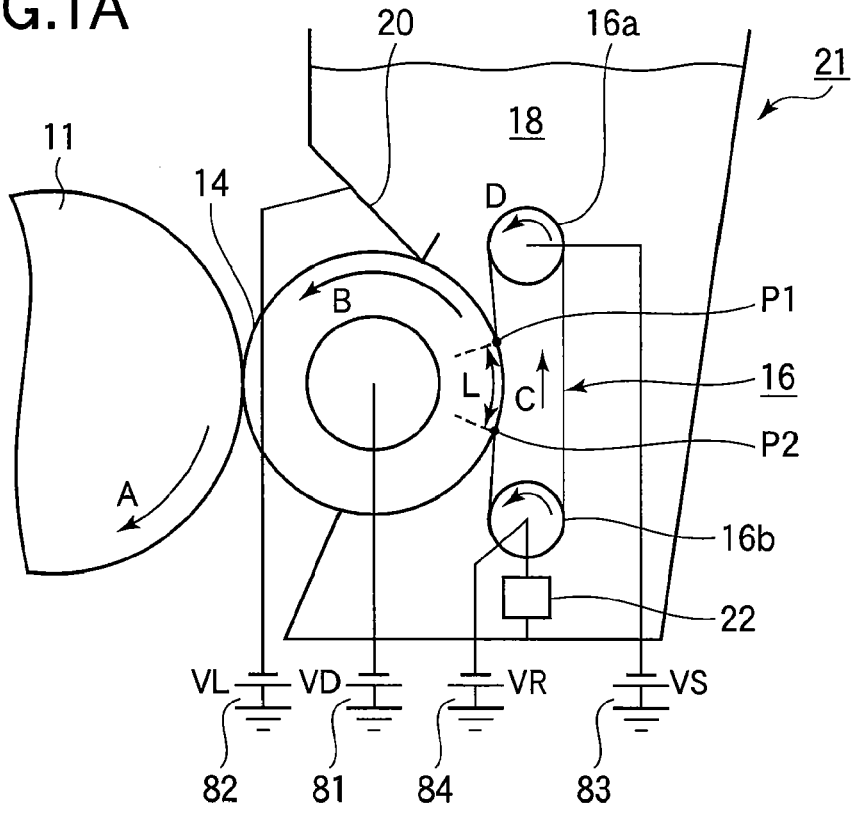
FIGS. 1A and 1B illustrate a general configuration of a developing unit of an image forming apparatus of a first embodiment.

FIG. 1A illustrates a general configuration of a developing unit of an image forming apparatus.

Figure 2:
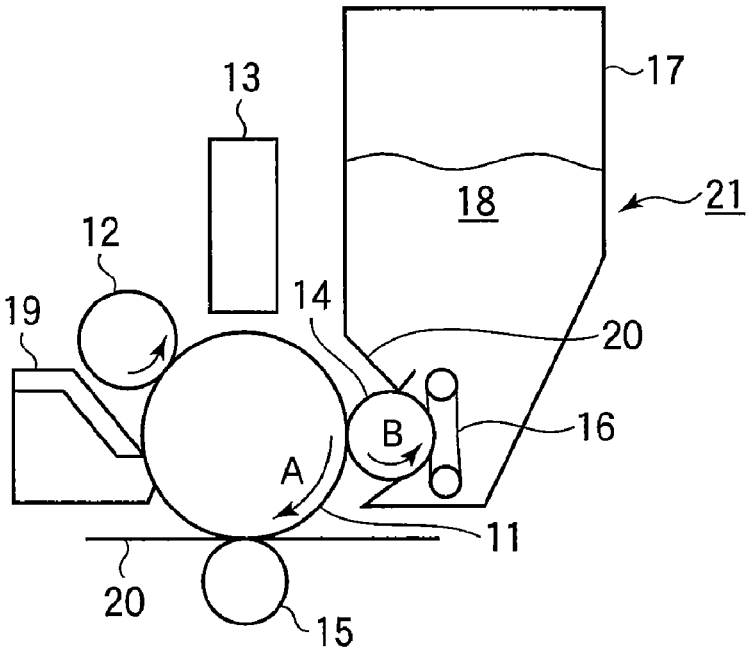
FIG. 2 illustrates a general configuration of a print engine.

FIG. 2 illustrates a general configuration of a print engine.

Referring to FIGS. 1A and 2, a photoconductive drum 11 includes an outer layer formed of an organic photoconductive material. A charging roller 12 uniformly charges the surface of the photoconductive drum 11 to approximately −600 V. The charging roller 12 is in rolling contact with the photoconductive drum 11, thereby minimizing wear of the surface of the photoconductive drum 11 due to friction. A negative direct current voltage is applied across the charging roller 12 and the photoconductive drum 11.

An LED print head 13 includes light emitting diodes (LEDs) as a light source, and illuminates the charged surface of the photoconductive drum 11 to form an electrostatic latent image. A laser print head may be used in place of the LED print head.

A developing unit 21 includes a developing roller 14, a toner supplying belt 16, a developing blade 20, and a toner reservoir 17. The developing roller 14 supplies toner 18 to the photoconductive drum 11. The developing blade 20 forms a thin layer of toner 18 on the developing roller 14. The toner reservoir 17 holds the fresh toner 18 therein.

The developing roller 14 is in contact with or in proximity to the photoconductive drum 11. The developing roller 14 rotates in a direction shown by arrow B, opposite to the direction shown by arrow A in which the photoconductive drum 11 rotates. The developing roller 14 supplies the toner 18 to the electrostatic latent image on the photoconductive drum 11, thereby developing the electrostatic latent image into a toner image. The toner image is transferred onto paper 29 with the aid of a transfer roller 15. The residual toner 18 remaining on the photoconductive drum 11 after transfer is removed by a cleaning blade 19 which serves as a cleaning device of the blade type. The paper 29 is then advanced to a fixing unit where the toner image is fused into the paper 29.

The developing roller 14 includes a metal shaft and a resilient layer formed on the metal shaft. The resilient layer is formed of a material such as silicone rubber or urethane rubber having a volume resistivity in the range of $10^8$ to $10^{10}$ Ωcm. A coating layer may be formed on the resilient layer. The developing roller 14 has a diameter of, for example, 20 mm.

The developing blade 20 is formed of a thin metal plate having a bent end portion which is in pressure contact with the outer surface of the developing roller 14. The toner supplying belt 16 is formed of a material such as semi-conductive urethane resin, polyimide resin, polyimideamide resin, urethane rubber, CR rubber, or silicone rubber. The toner supplying belt 16 has a volume resistivity in the range of $10^6$ to $10^8$ Ωcm, and a surface roughness Rz in the range of 5 to 15 μm.

The toner supplying belt 16 is entrained about a drive shaft 16*a* and a driven shaft 16*b*, which are formed of a highly electrically conductive material such as metal. When the drive shaft 16*a* rotates, the toner supplying belt 16 runs. As a result, the driven shaft 16*b* also rotates. The driven shaft 16*b* is urged by coil springs 22 in a direction away from the drive shaft 16*a*, so that the toner supplying belt 16 is maintained in a predetermined tension.

The toner supplying belt 16 between the drive shaft 16*a* and driven shaft 16*b* partially wraps around the developing roller 14 such that the toner supplying belt 16 is in contact with the developing roller 14 over a circumferential distance L of the developing roller greater than a nip formed between the developing roller 14 and a conventional toner supplying roller of sponge. For example, the conventional toner supplying roller having a diameter of 20 mm forms a nip of about 2 mm while the toner supplying belt 16 wraps around the developing roller 14 over a circumferential distance L of about 10 mm, from point P1 to point P2. When the drive shaft 16*a* rotates, the toner supplying belt 16 and the developing roller 14 run at substantially the same circumferential speed but in the opposite direction at the area in which the developing roller 14 rotates in contact with the toner supplying belt 16.

The toner 18 is one-component toner containing a resin such as polyester or polystyrene, a coloring agent, a releasing agent, and a charge control agent. An external additive such as silica is added to the surface of the toner. The toner is manufactured by pulverization or by polymerization. The toner 18 has a volume mean particle diameter in the range of 3-10 μm and an average degree of sphericity in the range of 0.9-0.98.

The average degree of sphericity of the toner 18 is obtained by dividing the total number of degrees of sphericity of toner particles by the number of the toner particles (e.g., 3500). The average degree of sphericity is measured with a particle size and shape image analysis flow cytometer (MODEL FPIA-2000, available from Sysmex Corporation). Degree of sphericity is a measure of surface roughness of the toner 18, and is given by the following equation.

Degree of sphericity=(total length of the perimeter of a projected area of a particle)/(total length of the perimeter of a projected image of a particle)

The projected area of a particle is an area of the projection of a particle and is a binary image. The total length of the perimeter of a projected image of a particle is a sum of lengths between two adjacent edge points on the perimeter.

If a toner particle is perfectly spherical, the degree of sphericity of the particle is 1.00. The degree of sphericity of a toner particle becomes smaller with increasing complexity of its shape.

The amount of charge of the toner 18 is measured by the charge blow-off method, and is in the range of −60 to −20 μQ/g depending on the charging agent and the external additive. A high voltage supply 81 applies a voltage VD to the developing roller 14. A high voltage supply 82 applies a voltage VL to the developing blade 20. A high voltage supply 83 applies a voltage VS to the drive shaft 16*a*. A high voltage supply 84 applies a voltage VR to the driven shaft 16*b*.

The operation of the printer of the aforementioned configuration will be described.

When image formation is initiated, a drive motor (not shown) rotates to drive the photoconductive drum 11, developing roller 14, and drive shaft 16*a* in rotation in directions shown by arrows A, B, and D, respectively. The toner supplying belt 16 runs in the toner reservoir 17 with the toner 18 adhering to the toner supplying belt 17. The toner 18 adheres to the toner supplying belt 16 by Van der Waals force and very small Coulomb forces resulting from the surface roughness of the toner supplying belt 16. As the toner supplying belt 16 runs, the toner 18 on the toner supplying belt 16 is brought into contact with the developing roller 14 at point P1.

Figure 3:
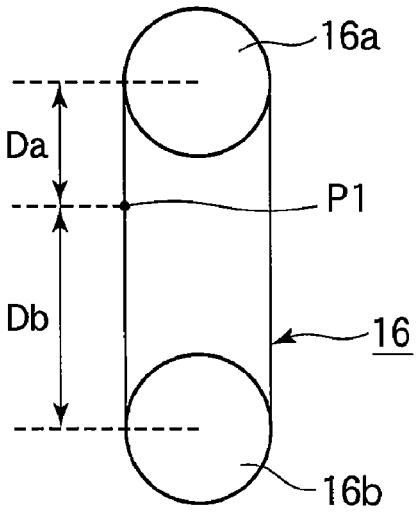
FIGS. 3 and 4 illustrate the voltages appearing on points P1 and P2, respectively.
Figure 4:
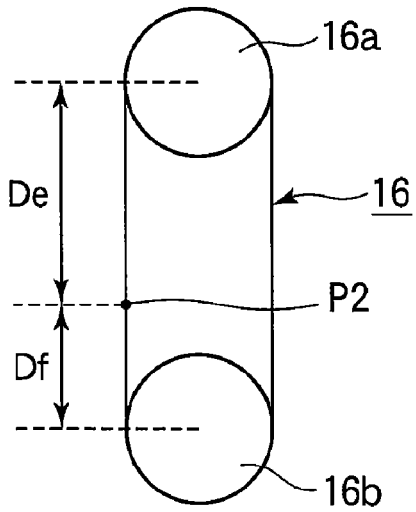

FIGS. 3 and 4 illustrate the voltages appearing on points P1 and P2, respectively.

When the voltages VS and VR are applied to the drive shaft 16*a* and driven shaft 16*b*, respectively, the voltages at points P1 and P2 are given as follows:

$$Vp1=\{Db/(Da+Db)\}\times(VS-VR) \quad (1)$$

$$Vp2=\{Df/(De+Df)\}\times(VS-VR) \quad (2)$$

where Vp1 is a voltage at point P1, Vp2 is a voltage at point P2, Da is the distance between point P1 and the drive shaft 16*a*, Db is the distance between point P1 and the driven shaft 16*b*, De is the distance between the point P2 and the drive shaft 16*a*, and Df is a distance between the point P2 and the driven shaft 16*b*.

In other words, the voltage difference Vs−VR is apportioned by the resistances proportional to the distance Da and Db, resulting in voltage drops Vp1 and Vp2 at points P1 and P2, respectively.

When the voltages VS, VR, and VD are −500 V, 0, and −250 V, and the distances Da and Db are 2 mm and 18 mm, respectively, the voltage at point P1 is −450 V from Equation (1). In other words, when the voltage VD is −250, Vp1 is −450, which creates an electric field required for the negatively charged toner 18 (e.g., −60 to −20 μQ/g) to be transferred onto the developing roller 14.

When the toner 18 deposited on the developing roller 14 passes under the developing blade 20, the blade 20 forms a thin layer of toner 18. The voltage VL is applied to the developing roller 20 for controlling the amount of charge and the thickness of the toner layer formed on the developing roller 14. As the developing roller 14 rotates in contact with the photoconductive drum 11, the thin layer of toner 18 is brought into contact with the electrostatic latent image formed on the photoconductive drum 11, thereby developing the electrostatic latent image with the toner 18 into a toner image.

A portion of the thin layer that is not brought into contact with the electrostatic latent image remains on the developing roller 14, and reaches point P2 as the developing roller 14 rotates further.

When the distances De and Df are 18 mm and 2 mm, respectively, a voltage of −50 V appears on point P2. In other words, when the voltage VD is −250 V, Vp2 is −50 V, which creates an electric field required for the negatively charged toner 18 to be transferred onto the toner supplying belt 16.

The toner 18 deposited on the toner supplying belt 16 reaches point P1 as the toner supplying belt 16 runs.

As described above, the voltage Vp1 at point P1 at which the toner supplying belt 16 moves into contact with the developing roller 14 differs from the voltage at point P2 at which the toner supplying belt 16 moves out of contact with the developing roller 14. The voltage Vp1 serves to establish an electric field through which the toner 18 is supplied from the toner supplying belt 16 to the developing roller 14. The voltage Vp2 serves to establish an electric field through which the remaining toner 18 is recovered from the developing roller 14 to the toner supplying belt 16.

Thus, the toner 18 remaining on the developing roller after the development of an electrostatic latent image may be removed from the developing roller 14. This eliminates the chance of the toner 18 remaining on the developing roller 14 of being reused in the subsequent development cycle, thereby preventing the remaining toner 18 from forming a reverse image of the electrostatic latent image as a whole.

The toner 18 recovered by the toner supplying belt 16 is then delivered to point P1, being re-used efficiently.

Because a conventional toner supplying roller 16 is formed of sponge, the toner supplying roller 16 will deteriorate after a relatively short-time use, causing variations of supply of the toner 18 to the developing roller 14 even within a page of image, resulting in variations in the density of image.

The pressure applied by the toner supplying belt 16 against the developing roller 14 may be controlled by adjusting the urging force of the coil springs 22 such that the toner supplying belt 16 exerts a relatively small abutting force on the developing roller 14. A small abutting force not only prolongs the useful life of the toner supplying belt 16 but also minimizes the force that rubs the surface of the developing roller 14, preventing the quality of toner 18 from being deteriorated as well as ensuring reliable image quality. The abutting force is preferably in the range of 5 to 20 g/cm for reliable abutment of the toner supplying belt 16 against the developing roller 14.

Figure 1B:
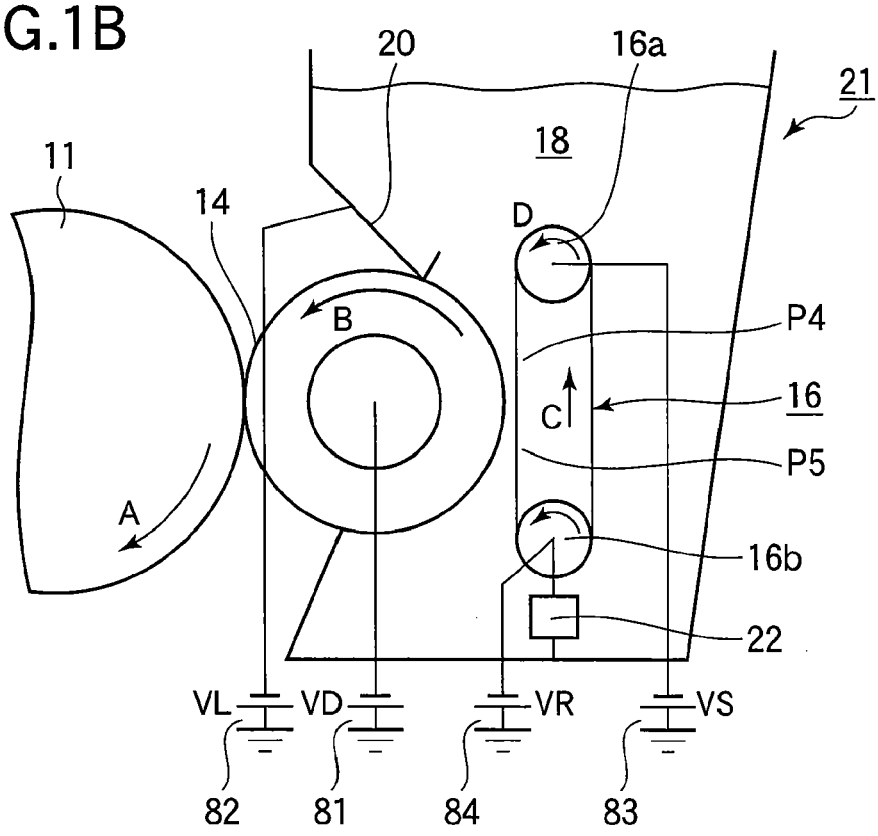

FIG. 1B illustrates a general configuration of a developing unit of an image forming apparatus where the toner supplying belt 16 is not in contact with the developing roller 14 but in proximity to the developing roller 14. Just as in the case of FIG. 1A, the high voltage supply 81 applies the voltage VD to the developing roller 14. The high voltage supply 83 applies the voltage VS to the drive shaft 16*a*. The high voltage supply 84 applies the voltage VR to the driven shaft 16*b*. In a similar manner to the voltages Vp1 and Vp2 given by Equations (1) and (2), the voltage Vp4 and the voltage Vp5 appears at point P4 and point P5, respectively. The voltage Vp4 creates an electric field across the developing roller 14 and the toner supplying belt 16 in a direction such that the charged toner 18 may be transferred from the toner supplying belt 16 to the developing roller 14. The voltage Vp5 creates an electric field across the developing roller 14 and the toner supplying roller 16 in a direction such that the charged toner 18 may be transferred from the developing roller 14 to the toner supplying belt 16. Thus, the configuration in FIG. 1B also provides the same advantages as that shown in FIG. 1A.

Second Embodiment

Elements similar to those in the first embodiment have been given the same reference numerals and the description thereof is omitted.

Figure 5:
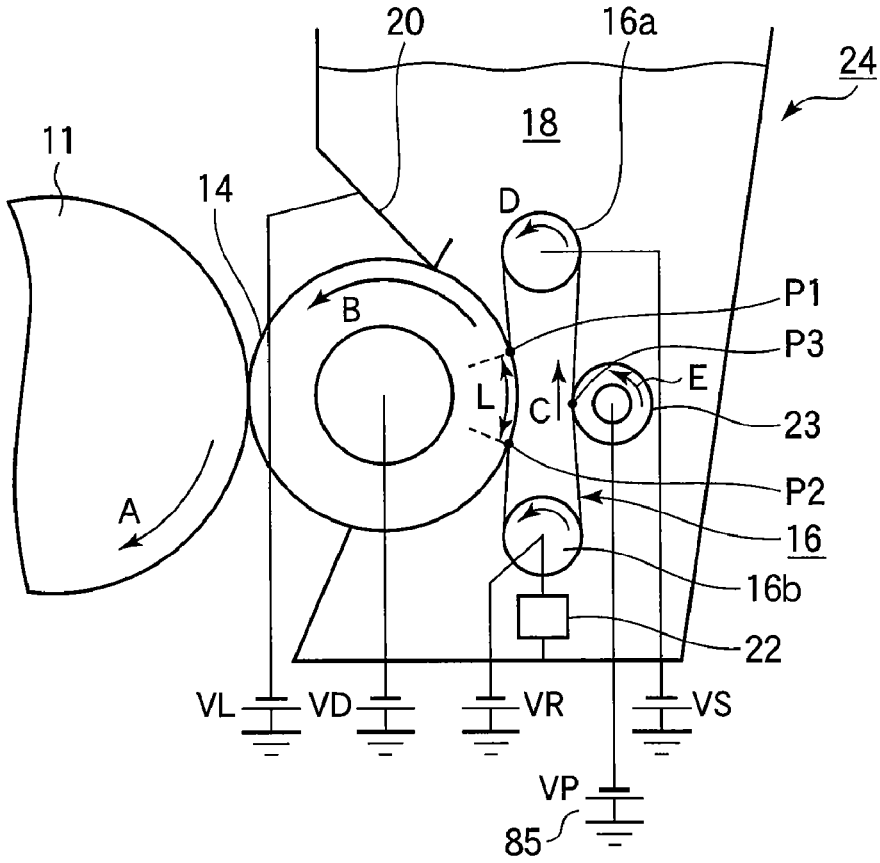
FIG. 5 illustrates a pertinent portion of a printer of a second embodiment.

FIG. 5 illustrates a pertinent portion of a printer of the second embodiment.

Figure 6:
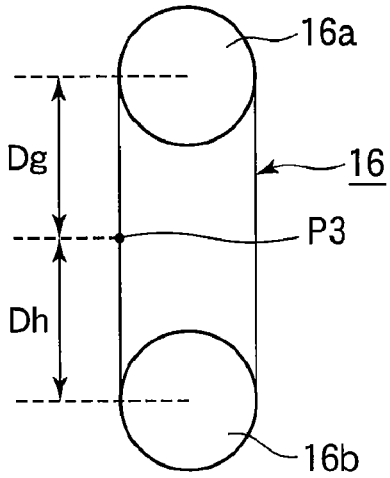
FIG. 6 illustrates the development process of a second embodiment.

FIG. 6 illustrates the development process of a second embodiment.

Referring to FIG. 5, a developing unit 24 includes a toner delivering roller 23 that rotates. The toner delivering roller 23 includes an electrically conductive shaft formed of a metal material. The electrically conductive shaft is covered with a semi-conductive rubber material or a foamed rubber material. The semi-conductive rubber material may be urethane or silicone and have a volume resistivity in the range of $10^6$-$10^8$ Ωcm. The foamed rubber material may be urethane or silicone and have a volume resistivity in the range of $10^6$-$10^8$ Ωcm. When image formation is initiated, a drive motor (not shown) rotates to drive a photoconductive drum 11, a developing roller 14, toner delivering roller 23, and a drive shaft 16*a* in rotation in directions shown by arrows A, B, and D, respectively.

The toner delivering roller 23 parallels to a developing roller 14 and is on the side of a toner supplying belt 16 opposite the toner developing roller 14. The toner delivering roller 23 abuts the toner supplying belt 16 between a drive shaft 16*a* and driven roller 16*b*. The toner delivering roller 23 is driven by a drive motor (not shown) to rotate in a direction shown by arrow E, which is the same direction as the toner supplying belt 16. The toner delivering roller 23 is in contact with the toner supplying belt 16 at point P3. The toner delivering roller 23 and the toner supplying belt 16 run in opposite directions at point P3. The toner delivering roller 23 is positioned relative to the toner supplying belt 16 such that the toner delivering roller 23 and the toner supplying belt 16 make no wrapped portion or little or no nip.

A power supply 85 applies a voltage VP to the toner delivering roller 23. While the photoconductive drum 11, developing roller 14, toner delivering roller 23, and a drive shaft 16*a* have been described as being driven by the same motor (not shown), the toner delivering roller 23 may be driven by a separate motor.

When the voltage VS is applied to the drive shaft 16*a* and the voltage VR is applied to the driven shaft 16*b*, the voltage at point P3 is given as follows:

$$Vp3=\{Dh/(Dg+Dh)\}\times(VS-VR) \quad (3)$$

where Vp3 is a voltage at point P3, Dg is the distance between point P3 and the drive shaft 16*a*, and Dh is the distance between point P3 and the driven shaft 16*b*.

In other words, the voltage difference VS−VR is apportioned by the resistances proportional to the distance Dg and Dh, resulting in the voltage Vp3 at point P3. The voltage Vp3 is substantially equal to the voltage VP.

For example, when the voltages VS, VR, and VP are −500 V, 0 V, and −250 V, respectively, and the distances Dg and Dh are 10 mm, Vp3 is −250 V.

The operation of a developing unit 21 of the aforementioned configuration will be described.

Upon initiation of image formation, the drive motor is energized to drive the photoconductive drum 11, developing roller 14, drive shaft 16*a*, and toner delivering roller 23 to rotate in directions shown by arrows A, B, D, and E. The toner delivering roller 23 rotates with the toner 18 adhering thereto while the toner supplying belt 16 runs with the toner 18 adhering thereto.

The toner 18 adhering to the toner delivering roller 23 is brought into contact with the toner supplying belt 16 at point P3. Because the voltage Vp3 at point P3 is substantially equal to the voltage VP applied to the toner delivering roller 23, no significant electric field is developed between toner supplying belt 16 and the toner delivering roller 23. Therefore, the toner 18 is smoothly supplied from the toner delivering roller 23 to the toner supplying belt 16. The resultant thickness of toner layer on the toner supplying belt 16 is substantially the same as that on the toner delivering roller 23.

A portion of the thin layer that is not brought into contact with the electrostatic latent image remains on the developing roller, and reaches point P3 as the toner supplying belt 16 runs further. Because of negligible electric field between toner supplying belt 16 and the toner delivering roller 23, the toner delivering roller 23 rubs the toner 18 on the toner supplying belt 16 to prevent the remaining toner 18 from forming a reverse image of the electrostatic latent image as a whole.

Because the toner delivering roller 23 delivers the toner 18 to the toner supplying belt 16 continuously, a layer of the toner 18 may be formed on the toner supplying belt 16. This ensures reliable supply of the toner 18 to the developing roller 14.

The toner 18 not used for the development of an electrostatic latent image is recovered by the toner supplying belt 16, and the layer of the toner 18 is scraped off the toner supplying belt 16 by the toner delivering roller 23. This provides reliable removal of the reversal image of the electrostatic latent image remaining in the layer of the toner 18 formed on the developing roller 14.

Although the first and second embodiments have been described with respect to a printer, the present invention may be applicable to a copying machine, a facsimile machine, and a multi function apparatus of these machines.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing apparatus including a developer bearing body that supplies developer to an image bearing body, the developing apparatus comprising:

a developer supplying belt that supplies the developer to the developer bearing body; and a voltage supply that causes a first voltage to be developed on a first point on said developer supplying belt and that causes a second voltage to be developed on a second point on said developer supplying belt;

wherein said developer supplying belt is in contact with the developer bearing body over a distance from the first point to the second point.

2. The developing apparatus according to claim 1, further comprising:

a drive shaft that is driven in rotation, said drive shaft causing said developer supplying belt to run; and a driven shaft that is rotated by said developer supplying belt when said developer supplying belt runs;

wherein said power supply applies voltages to said drive shaft and driven shaft to produce the first voltage and the second voltage, the voltage applied to said drive shaft being different from the voltage applied to said driven shaft.

3. The developing apparatus according to claim 1, wherein the first voltage creates an electric field through which the developer is supplied from said developer supplying belt to said developer bearing body, and the second voltage creates an electric field by which the developer is recovered from said developer bearing body to said developer supplying belt.

4. The developing apparatus according to claim 1, further comprising a rotating body that rotates in contact with said developer supplying belt and supplies the developer to said developer supplying belt.

5. The developing apparatus according to claim 4, wherein said developer supplying belt is in an abutting relation with the developer bearing body;

said voltage supply causes a first voltage to be developed at a first point at which said developer supplying belt contacts said developer bearing body and a second voltage at a second point at which said developer supplying belt contacts said developer bearing body.

6. An image forming apparatus incorporating said developing apparatus according to claim 1.

7. The developing apparatus according to claim 1, wherein said developer supplying belt is disposed about at least a first member and a second member, said developer supplying belt being in contact with said developer bearing body at an area between the first member and the second member.

8. A developing apparatus including a developer bearing body that supplies developer to an image forming body, comprising:

a drive shaft driven in rotation by an external drive source;

a driven shaft;

a developer supplying belt entrained about said drive shaft and said driven shaft, said developer supplying belt supplying developer to the developer bearing body and in contact with the developer bearing body over a distance of the developer supplying belt;

an urging member that maintains said developer supplying belt in tension; and a voltage supply that causes a potential difference to be developed across said drive shaft and said driven shaft.

9. The developing apparatus according to claim 8, wherein the first voltage develops a first electric field across said developer supplying belt and said developer bearing body such that the developer is supplied from said developer supplying belt to said developer bearing body through the first electric field;

wherein the second voltage develops a second electric field across said developer supplying belt and said developer bearing body such that the developer is recovered from said developer bearing body to said developer supplying belt through the second electric field.

10. An image forming apparatus incorporating said developing apparatus according to claim 8.

11. The developing apparatus according to claim 8, wherein said developer supplying belt is disposed about at least a first member and a second member, said developer supplying belt being in contact with said developer bearing body at an area between the first member and the second member.

12. A developing apparatus including a developer bearing body that supplies developer to an image bearing body, the developing apparatus comprising:

a developer supplying belt that supplies the developer to the developer bearing body;

said developer supplying belt being formed of a semi-conductive material having a volume resistivity in the range of $10^6$ to $10^8$ Ωcm and being in contact with the developer bearing body;

a voltage supply that causes a first voltage to be developed on a first point on said developer supplying belt and that causes a second voltage to be developed on a second point on said developer supplying belt; and a rotating body that rotates in contact with said developer supplying belt.

13. The developing apparatus according to claim 12, wherein the developer bearing body has a volume resistivity in the range of $10^8$ to $10^{10}$ Ωcm.

14. A developing apparatus including a developer bearing body that supplies developer to an image bearing body, the developing apparatus comprising:

a developer supplying belt that supplies the developer to the developer bearing body;

said developer supplying belt being formed of a semi-conductive material having a volume resistivity in the range of $10^6$ to $10^8$ Ωcm and being in contact with the developer bearing body; and a voltage supply that causes a first voltage to be developed on a first point on said developer supplying belt and that causes a second voltage to be developed on a second point on said developer supplying belt.

15. The developing apparatus according to claim 14, further comprising a rotating body that rotates in contact with said developer supplying belt.

16. The developing apparatus according to claim 14, wherein the developer bearing body has a volume resistivity in the range of $10^8$ to $10^{10}$ Ωcm.

17. A developing apparatus, comprising:

a developer bearing body in contact with an image forming body;

a first shaft driven in rotation by a drive source;

a second shaft; and a developer supplying belt entrained about said first shaft and second shaft and runs when said first shaft is driven in rotation, said developer supplying belt being partially in a wrapping contact with the developer bearing body and in contact with the developer bearing body over a distance of the developer supplying belt; and a power supply that applies voltages to said first shaft and said second shaft such that a voltage drop appears in said developer supplying belt in a direction of travel of said developer supplying belt;

wherein said power supply applies a voltage to the developer bearing body such that a first electric field having a first direction is developed across the developer bearing body and a first portion of said developer supplying belt in contact with the developer bearing body, and such that a second electric field having a second direction opposite to the first direction is developed across the developer bearing body and a second portion of said developer supplying belt in contact with the developer bearing body.

18. The developing apparatus according to claim 17, wherein the first electric field allows the developer to be supplied from said developer supplying belt to the developer bearing body.

19. The developing apparatus according to claim 17, the second electric field allows the developer to be recovered from the developer bearing body to said developer supplying belt.

20. The developing apparatus according to claim 17, further comprising an urging member that urges said developer supplying belt to maintain said developer supplying belt in tension.

21. The developing apparatus according to claim 17, further comprising a rotating body that rotates in contact with a portion of said developer supplying belt after the developer has been recovered from the developer bearing body to said developer supplying belt and before the developer is supplied to the developer bearing body.

22. The developing apparatus according to claim 17, wherein said developer supplying belt is disposed about at least a first member and a second member, said developer supplying belt being in contact with said developer bearing body at an area between the first member and the second member.

23. A developing apparatus comprising:

a developer bearing body in contact with an image forming body;

a first shaft driven in rotation by a drive source;

a second shaft; and a developer supplying belt entrained about said first shaft and second shaft and runs when said first shaft is driven in rotation, said developer supplying belt being partially in a wrapping contact with the developer bearing body and being formed of a semi-conductive material having a volume resistivity in the range of $10^6$ to $10^6$ Ωcm; and a power supply that applies voltages to said first shaft and said second shaft such that a voltage drop appears in said developer supplying belt in a direction of travel of said developer supplying belt;

wherein said power supply applies a voltage to the developer bearing body such that a first electric field having a first direction is developed across the developer bearing body and a first portion of said developer supplying belt in contact with the developer bearing body, and such that a second electric field having a second direction opposite to the first direction is developed across the developer bearing body and a second portion of said developer supplying belt in contact with the developer bearding body.

24. The developing apparatus according to claim 23, wherein the developer bearing body has a volume resistivity in the range of $10^8$ to $10^{10}$ Ωcm.

* * * * *